United States Patent [19]

Huang

[11] 4,201,836

[45] May 6, 1980

[54] ALUMINUM SUBSTRATES GRAINED WITH A SATURATED SOLUTION OF ALUMINUM SALTS OF MINERAL ACIDS

[75] Inventor: Jen-Chi Huang, Yonkers, N.Y.

[73] Assignee: Polychrome Corporation, Yonkers, N.Y.

[21] Appl. No.: 937,222

[22] Filed: Aug. 28, 1978

[51] Int. Cl.[2] ..... G03C 1/94; B41N 3/02; B41N 3/04; C25F 3/04

[52] U.S. Cl. ..... 428/457; 156/665; 204/33; 204/58; 204/140; 427/307; 427/309; 427/435; 427/444; 428/908; 430/302; 430/526

[58] Field of Search ..... 428/105, 908, 457; 427/307, 309, 435, 444; 204/33, 58, 140; 156/665; 96/86 R, 33

[56] References Cited

U.S. PATENT DOCUMENTS

| | | | |
|---|---|---|---|
| 2,209,712 | 7/1940 | Brennan | 204/33 X |
| 3,072,546 | 1/1963 | Wruck | 204/141 |
| 3,073,765 | 1/1963 | Adams | 204/141 |
| 3,755,116 | 8/1973 | Terai et al. | 204/33 X |
| 4,152,158 | 5/1979 | Chu | 204/33 X |

FOREIGN PATENT DOCUMENTS 896563 5/1962 United Kingdom .

*Primary Examiner*—Harold Ansher

[57] ABSTRACT

A method for the production of aluminum substrates useful in the production of lithographic printing plates which comprises graining the surface of an aluminum sheet in a saturated solution of an aluminum salt of a mineral acid to which up to 10% of a mineral acid has been added, with optional electrolysis.

18 Claims, No Drawings

ALUMINUM SUBSTRATES GRAINED WITH A SATURATED SOLUTION OF ALUMINUM SALTS OF MINERAL ACIDS

BACKGROUND OF THE INVENTION

This invention relates to the treatment of aluminum surfaces, and more particularly to the treatment of aluminum surfaces to provide a surface thereon suitable for use in the production of lithographic printing plates.

There are many methods and processes which have been heretofore employed in the treatment of aluminum surfaces to render them suitable for use in the production of lithographic printing plates. One such method involves the electrolytic treatment of aluminum, for example, electrolytic etching by use of a hydrochloric acid electrolyte. Various prior art publications, for example, U.S. Pat. Nos. 3,072,546 and 3,073,765 and British Pat. Nos. 879,768 and 896,563 describe the treatment of aluminum surfaces with hydrochloric acid while applying an alternating current to the aluminum plates to render the plates suitable for lithographic use. While this treatment has been taught to be satisfactory, it actually possesses the undersirable property of requiring large quantities of expensive acids which, when spent, must be discarded as ecologically unacceptable effluent.

In addition, in the treatment of such aluminum association alloys as 1100, a relatively large amount of electrical power has been required to obtain the degree of etching desired. It has also been found in the practice of the prior art processes that uniform etching of the surface is not obtained, and the character of the grain imparted to the surface is not consistent, portions thereof being relatively coarser than others, thus yielding an undersirable irregular surface which is not ideally suitable for lithographic use. When the surface of the aluminum sheet is irregular and non-uniform, it can interfere with the subsequent printing process when the surface is subsequently coated with a photosensitive resin as is employed in normal lithographic processes as is well known to the skilled worker.

Heretofore, various suggestions have been made to overcome the disadvantages encountered in the practice of the prior art processes. One such suggestion in U.S. Pat No. 3,963,594 involves the use of a hydrochloric acid and gluconic acid electrolyte for etching. Other suggestions such as those contained in U.S. Pat. Nos. 3,342,711; 3,365,380 and 3,366,558 refer to an electrolytic polishing effect obtained on aluminum and other metals using a mixture which may include various electrolytes such as sulfuric acid and gluconic acid.

SUMMARY OF THE INVENTION

The present invention teaches a method of graining the surface of an aluminum sheet substrate which comprises subjecting said substrate to a saturated aqueous solution of an aluminum salt of a mineral acid to which optionally up to 10 percent of a mineral acid may be added. Optionally, the graining action of this solution may be aided by electrolysis.

The important improvement with this method is that no effluent discharge is produced. As a moving web of aluminum is passed through the solution, a graining action takes place. Necessarily, there are aluminum salt reaction products formed in the reaction between the web aluminum and the graining solution. However, since the graining solution is already saturated with aluminum salt, the additional aluminum salts formed merely precipitate out of the solution. The solution is maintained by merely replenishing the graining solution by adding whatever ingredients, such as excess acids, are required and by periodically filtering the precipitates. The need to frequently discharge a spent graining solution is thus obviated.

It is, therefore, an object of the present invention to provide an improved method of graining the surface of aluminum sheets.

It is another object of the present invention to provide an improved method of graining the surface of aluminum sheets whereby the need to discharge spent graining solutions as effluent is obviated.

These and other objects of the instant invention will be in part discussed and in part apparent upon a consideration of the detailed description of the preferred embodiment.

DETAILED DESCRIPTION OF THE PREFERRED EMBODIMENT

The aluminum sheets which may be employed in the practice of this invention, include those which are made from aluminum alloys which contain substantial amounts of impurities, including such alloys as aluminum association alloys 1100 and 3003. The thickness of the aluminum sheets which may be employed in the practice of this invention may be such as are usually and well known to be employable for such purposes, for example those which are from 0.004 inches to 0.025 inches in thickness; however, the exact choice of aluminum sheet may be left to the discretion of the skilled worker.

In the practice of the instant invention, an aluminum web is immersed in a saturated aqueous solution of an aluminum salt of a mineral acid to which optionally up to 10% by weight of a mineral acid has been added. The quantity of acid is based upon the weight of the anhydrous parts of said acid to the weight of the saturated solution.

Non-limiting examples of such aluminum salts include aluminum chloride, sulfate, phosphate, borate, acetate and nitrate.

Non-limiting examples of the mineral acids employable within the context of the instant invention include hydrochloric acid, sulfuric acid, phosphoric acid, boric acid, acetic acid and nitric acid.

The preferred immersion time ranges from about 30 seconds to 5 minutes, or more preferably from 1 to 4 minutes, while the solution is maintained at a preferred temperature of from about 25° C. to 110° C., more preferably from 50° C. to 60° C.

Optionally, the graining or etching action may be aided by the use of electrolysis. In such a case, it is preferred that the aluminum be subjected, under electrolyzing conditions, to a current density of about 5 to 30 amps per square decimeter for up to about 3 minutes. The voltage employed is not critical.

The exact parameters of the conditions under which the electrolytic etching may be carried out may be varied and are within the purview of the skilled worker, depending upon the results wishes to be achieved in each specific case.

Subsequent to the graining of the aluminum surface hereunder, the aluminum may be further treated to produce the desired lithographic printing plates. Thus, the electrolytically etched aluminum may be subsequently coated with a lithographically suitable photosensitive coating for such purposes or, alternatively, the electrolytically etched surface may be anodized, for example with direct current in a suitable electrolyte, such as sulfuric acid, prior to the application to the thus anodized surface of a lithographically suitable photosensitive coating.

The invention may be illustrated by the following examples:

EXAMPLE 1

A sheet of degreased grade 1100 aluminum was immersed in an aqueous solution of saturated aluminum chloride maintained at 110° C. for two minutes. After cleaning and drying, the sample was examined under an electron microscope. The sheet surface possessed a uniformly roughened topography which successfully accepted an adherent photosensitive coating commonly used in lithography.

EXAMPLE 2

Example 1 was repreated except the solution further comprised 10% hydrochloric acid. Similar results were obtained.

EXAMPLE 3

Example 1 was repeated except the aluminum was subjected to electrolysis at 15 amps/dm$^2$. Similar results were obtained.

EXAMPLE 4

Example 2 was repeated except the aluminum was subjected to electrolysis at 15 amps/dm$^2$. Similar results were obtained.

It is, of course, to be understood that the foregoing examples are for the purpose of illustrating the invention only and are not to be construed as limitations to the scope of the invention as claimed hereinafter.

What is claimed is:

1. A process for the treatment of an aluminum sheet to provide thereon a substantially consistent and uniformly roughened surface suitable for lithographic uses, which comprises immersing said aluminum in a saturated aqueous solution of an aluminum salt of a mineral acid.

2. The process of claim 1 wherein the time of immersion of said aluminum in said solution is from about 30 seconds to about 5 minutes.

3. The process of claim 1 wherein said solution further comprises up to about 10% by weight of a mineral acid.

4. The process of claim 1 wherein said aluminum is electrolyzed in said solution.

5. The process of claim 3 wherein the aluminum is electrolyzed in said solution.

6. The process of claim 1 wherein said aluminum salt is selected from the group consisting of aluminum chloride, sulfate, phosphate, borate, acetate and nitrate.

7. The process of claim 3 wherein said acid is selected from the group consisting of hydrochloric acid, sulfuric acid, phosphoric acid, boric acid, nitric acid and acetic acid.

8. The process of claim 3 wherein said acid is hydrochloric acid and said aluminum salt is aluminum chloride.

9. The aluminum sheet produced by the method of claim 1.

10. A lithographic printing plate which comprises the aluminum sheet produced by the method of claim 1 and a lithographically suitable photosensitizer coated on said sheet.

11. The process of claim 1 wherein the solution temperature is maintained at from 25° C. to 110° C.

12. The process of claim 11 wherein the solution temperature ranges from 50° C. to 60° C.

13. The process of claim 4 wherein the electrolysis is conducted by a current density of from 5 to 30 amperes per square decimeter for up to three minutes.

14. The process of claim 1 which comprises the subsequent step of anodizing said sheet.

15. A lithographic printing plate prepared by a process which comprises immersing an aluminum sheet in a saturated solution of aluminum chloride or aluminum nitrate maintained at from 25° C. to 110° C. for from 30 seconds to 5 minutes; then anodizing said sheet; and coating a lithographically suitable photosensitizer on said sheet.

16. The lithographic printing plate of claim 15 wherein said solution further comprises up to 10% by weight of hydrochloric or nitric acid.

17. A lithographic printing plate prepared by a process which comprises electrolyzing an aluminum sheet in a saturated solution of aluminum chloride or aluminum nitrate maintained at from 25° C. to 110° C. for up to 3 minutes at a current density of from 5 to 30 amperes per square decimeter; then anodizing said sheet; and coating a lithographically suitable photosensitizer on said sheet.

18. The lithographic printing plate of claim 17 wherein said solution further comprises up to 10% by weight of hydrochloric or nitric acid.

* * * * *